US008115681B2

(12) United States Patent
Ryou et al.

(10) Patent No.: US 8,115,681 B2
(45) Date of Patent: Feb. 14, 2012

(54) ULTRA-WIDEBAND ANTENNA HAVING A BAND NOTCH CHARACTERISTIC

(75) Inventors: Byung-Hoon Ryou, Seoul (KR); Won-Mo Sung, Gyeonggi-do (KR); Jae-Hoon Choi, Seoul (KR); Woo-Young Choi, Seoul (KR); Yang-Woon Roh, Gyeonggi-do (KR)

(73) Assignee: EMW Co., Ltd., Incheon (KR)

( * ) Notice: Subject to any disclaimer, the term of this patent is extended or adjusted under 35 U.S.C. 154(b) by 317 days.

(21) Appl. No.: 11/909,795

(22) PCT Filed: Apr. 25, 2006

(86) PCT No.: PCT/KR2006/001545

§ 371 (c)(1),
(2), (4) Date: Apr. 1, 2010

(87) PCT Pub. No.: WO2006/115363

PCT Pub. Date: Nov. 2, 2006

(65) Prior Publication Data

US 2010/0182210 A1 Jul. 22, 2010

(30) Foreign Application Priority Data

Apr. 26, 2005 (KR) ..... 10-2005-0034429
Apr. 26, 2005 (KR) ..... 10-2005-0034430

(51) Int. Cl.
*H01Q 1/38* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 5,886,668 A * 3/1999 Pedersen et al. ..... 343/702
6,160,522 A * 12/2000 Sanford ..... 343/769
6,400,329 B1 6/2002 Barnes
6,590,545 B2 7/2003 McCorkle
6,621,462 B2 9/2003 Barnes
6,876,332 B1 4/2005 Chung et al.

(Continued)

FOREIGN PATENT DOCUMENTS

CN 1124066 6/1996

(Continued)

OTHER PUBLICATIONS

KR 10-2005-0034429—Office Action pertaining to corresponding Korean application.
KR 10-2005-0034429—Allowance pertaining to corresponding Korean application.
KR 10-2005-0034430—Allowance pertaining to parent Korean application.
PCT International Search Report PCT/KR2006/001545, mailed Aug. 8, 2006, 2 pages.

(Continued)

*Primary Examiner* — Hoanganh Le
(74) *Attorney, Agent, or Firm* — Blakely, Sokoloff, Taylor & Zafman LLP

(57) ABSTRACT

The present invention discloses an antenna for ultra-wide-band (UWB) communication having a band-stop characteristic. According to an embodiment of the present invention, the UWB antenna is a patch antenna employing microstrip feeding. In order to expand a bandwidth at a low frequency band, a stub is formed in a radiating element. Furthermore, since steps are formed in a ground plane, an antenna characteristic at an intermediate frequency band can be improved and a UWB characteristic can be obtained. According to another embodiment of the present invention, the UWB antenna is a patch antenna employing microstrip feeding and has a recess formed in the ground plane, thereby implementing the UWB characteristic. The antenna of the present invention has an inverse U-shaped slot formed in the radiating element, thus implementing the band-stop characteristic at the UNII band. In addition, the antenna of the present invention has includes a ground plane having a small area and has omnidirectional radiating patterns accordingly.

10 Claims, 11 Drawing Sheets

U.S. PATENT DOCUMENTS

| | | | | |
|---|---|---|---|---|
| 7,855,686 | B2 * | 12/2010 | Chen et al. | 343/700 MS |
| 2004/0090366 | A1 * | 5/2004 | Wong et al. | 343/700 MS |
| 2004/0100407 | A1 | 5/2004 | Okado | |
| 2004/0196187 | A1 | 10/2004 | Yeh | |
| 2005/0062662 | A1 | 3/2005 | Miyoshi et al. | |
| 2005/0156788 | A1 * | 7/2005 | Lin | 343/700 MS |
| 2006/0028386 | A1 * | 2/2006 | Ebling et al. | 343/754 |
| 2007/0085741 | A1 * | 4/2007 | Rafi et al. | 343/700 MS |

FOREIGN PATENT DOCUMENTS

| | | |
|---|---|---|
| EP | 1 501 155 | 1/2005 |
| JP | 05-037226 | 2/1993 |
| JP | 2004-328703 | 11/2004 |
| JP | 2005-094499 | 4/2005 |
| KR | 2001-0096957 | 11/2001 |
| KR | 10-0322385 | 1/2002 |
| KR | 10-0323394 | 1/2002 |
| KR | 10-0365733 | 12/2002 |
| KR | 2003-0089825 | 11/2003 |
| KR | 10-2004-0049525 | 6/2004 |
| KR | 10-2004-0052869 A | 6/2004 |
| KR | 10-2004-0066441 | 7/2004 |
| KR | 10-2004-0089902 | 10/2004 |
| KR | 10-2004-0108212 | 12/2004 |
| KR | 10-2005-0010549 | 1/2005 |
| WO | 03/034538 | 4/2003 |

OTHER PUBLICATIONS

Jong-Pil Lee, et al., "Bow-Tie Wide-Band Monopole Antenna with the Novel Impedance-Matching Technique," Microwave and Optical Technology Letters, vol. 33, No. 6, pgs. 448-452, (Jun. 20, 2002).

First Office Action for Japanese Patent Application No. 2008-503973. 2 pgs., (Feb. 9, 2010).

Second Office Action for Japanese Patent Application No. 2008-503973, 2 pgs., (Oct. 12, 2010).

Decision of Refusal for Japanese Patent Application No. 2008-503973, 2 pgs., (Apr. 26, 2011).

First Office Action Chinese Patent Application No. 200680013917.9, 4pgs., (Feb. 24, 2011).

First Office Action for European Patent Application No. 06757523. Mar. 1248, 6 pgs., (Aug. 20. 2008).

Second Office Action for European Patent Application No. 06757523.Mar. 1248, 3 pgs., (Dec. 30, 2008).

Third Office Action for European Patent Application No. 06757523. Mar. 1248, 5 pgs., (Oct. 28, 2009).

Summons to Attend Oral Proceedings for European Patent Application No. 06757523.Mar. 1248, 5 pgs., (Oct. 21, 2010).

Extended European Search Report for European Patent Application No. 06757523,Mar. 1248, 9 pgs., (Jun. 17, 2008).

Written Opinion of the International Search Authority for PCT Counterpart Application No. PCT/KR2006/001545, 3 pgs (Aug. 8, 2006).

* cited by examiner

[Fig. 1]
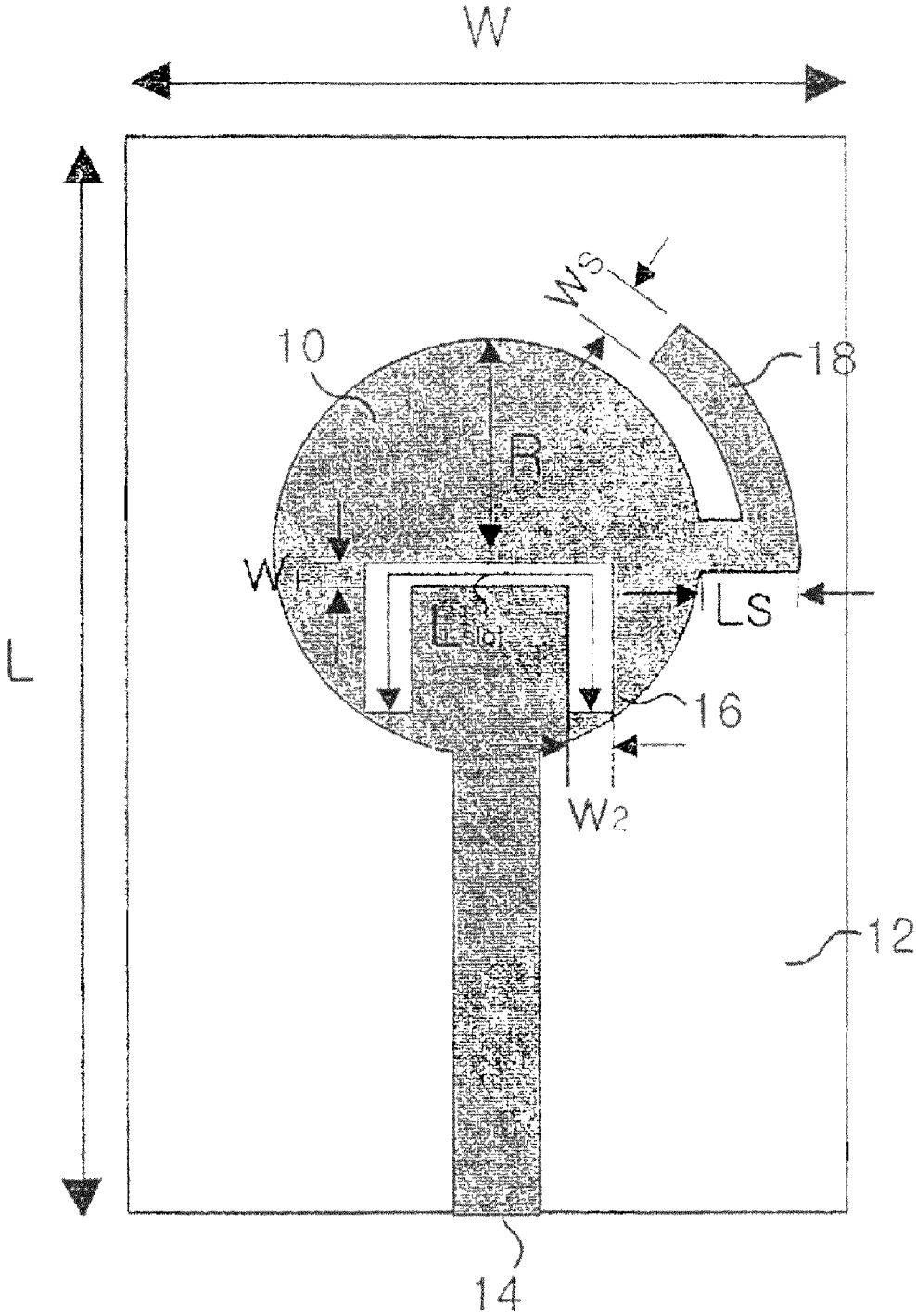

[Fig. 2]
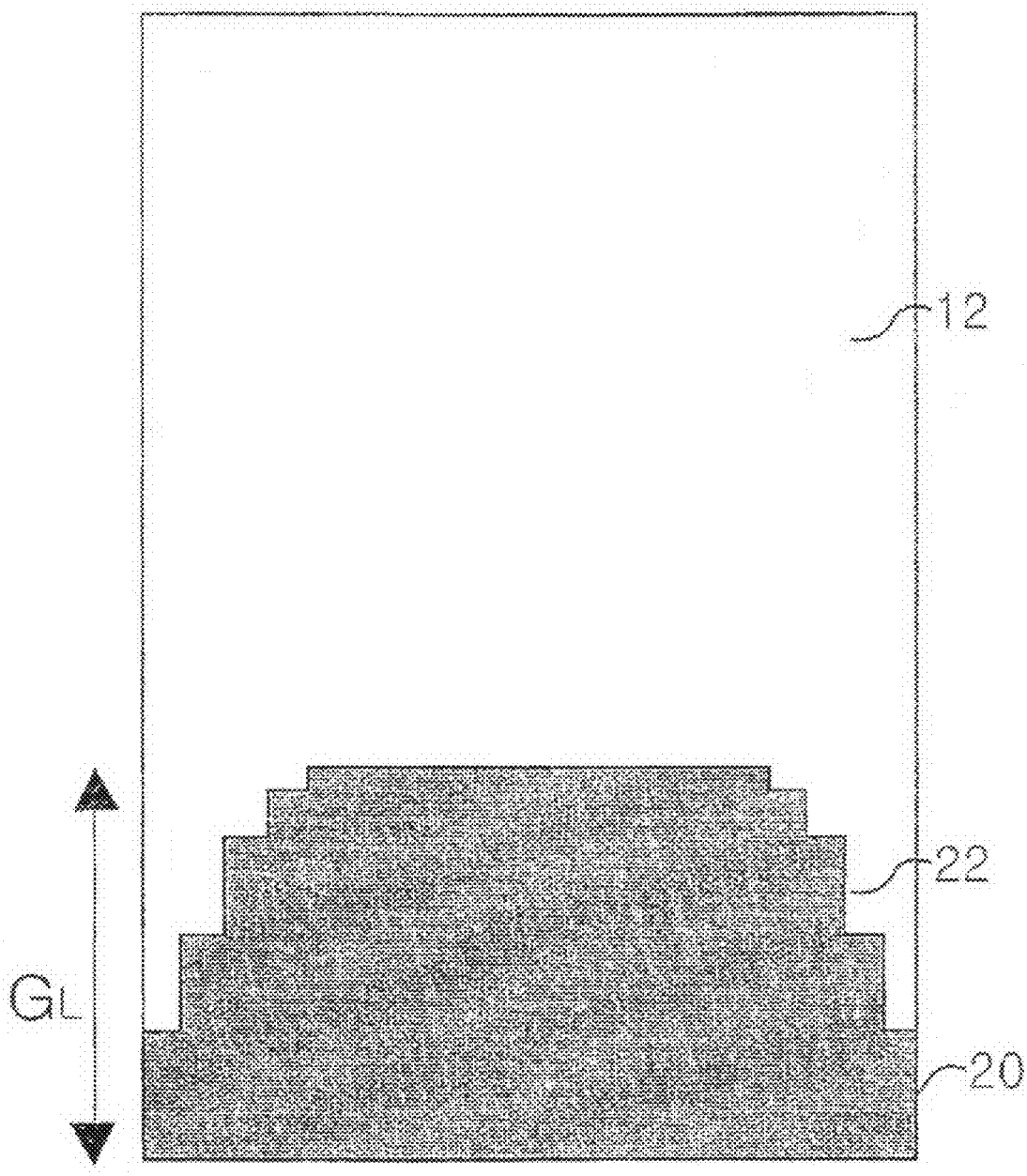

[Fig. 3]
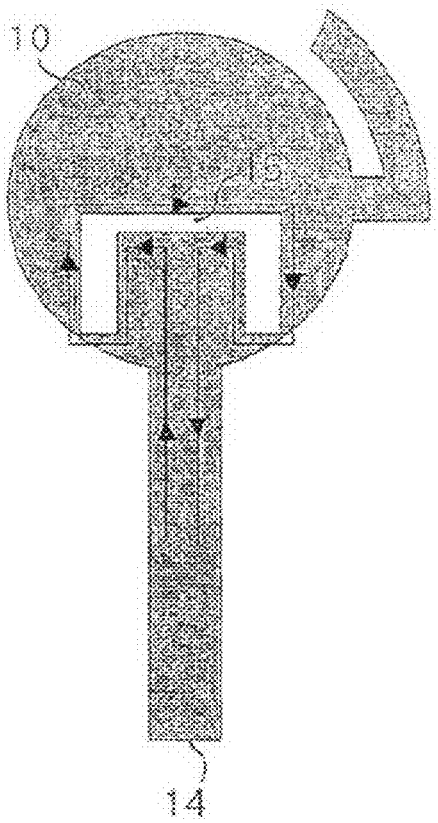
[Fig. 4]
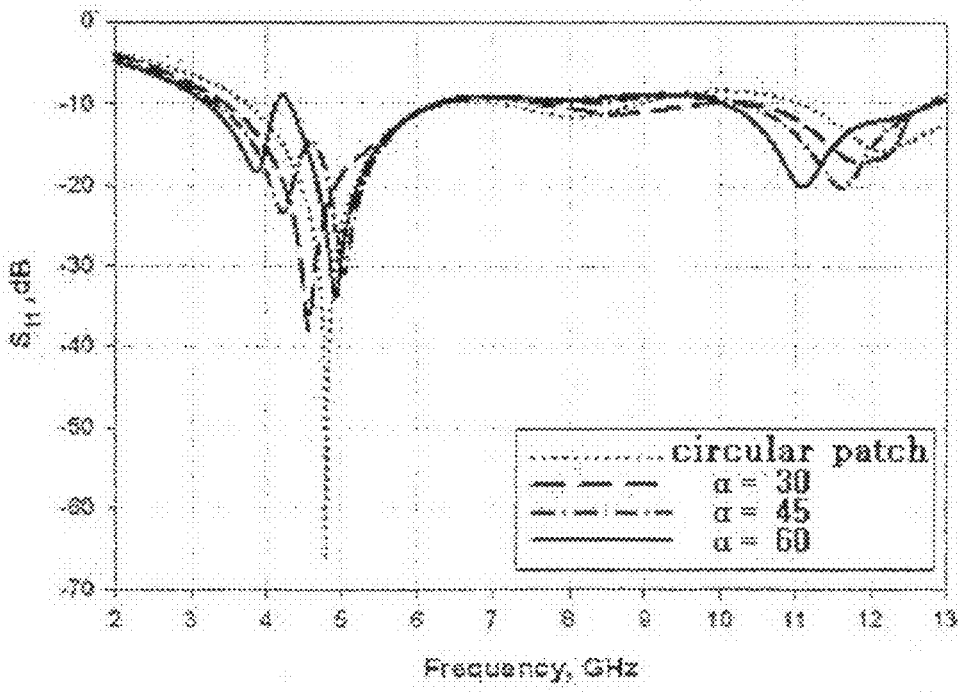

[Fig. 5]
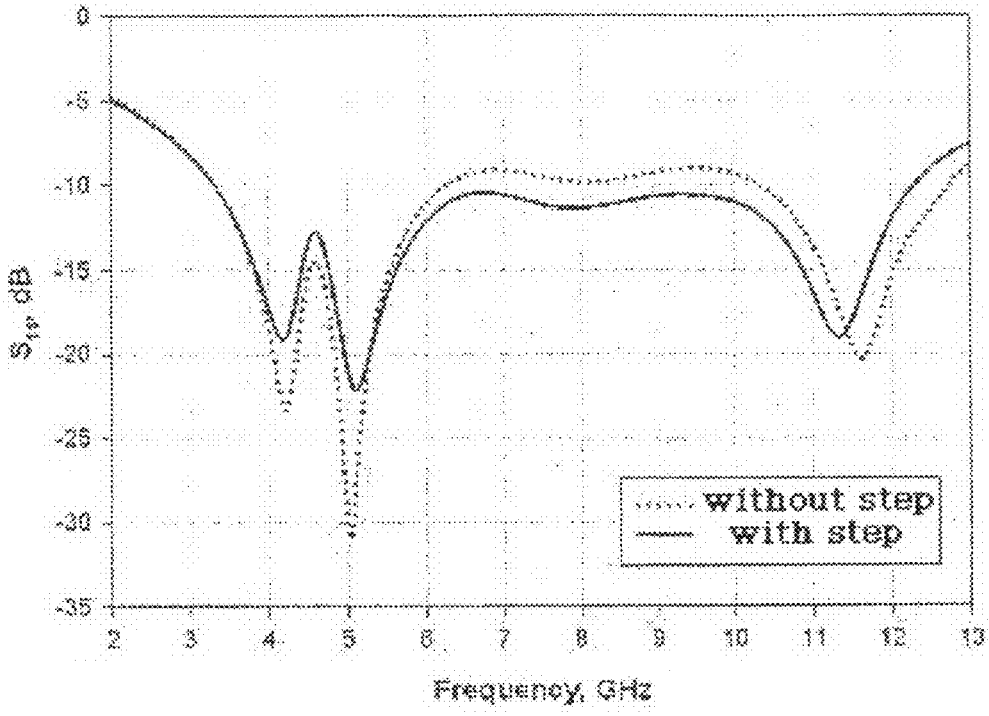
[Fig. 6]
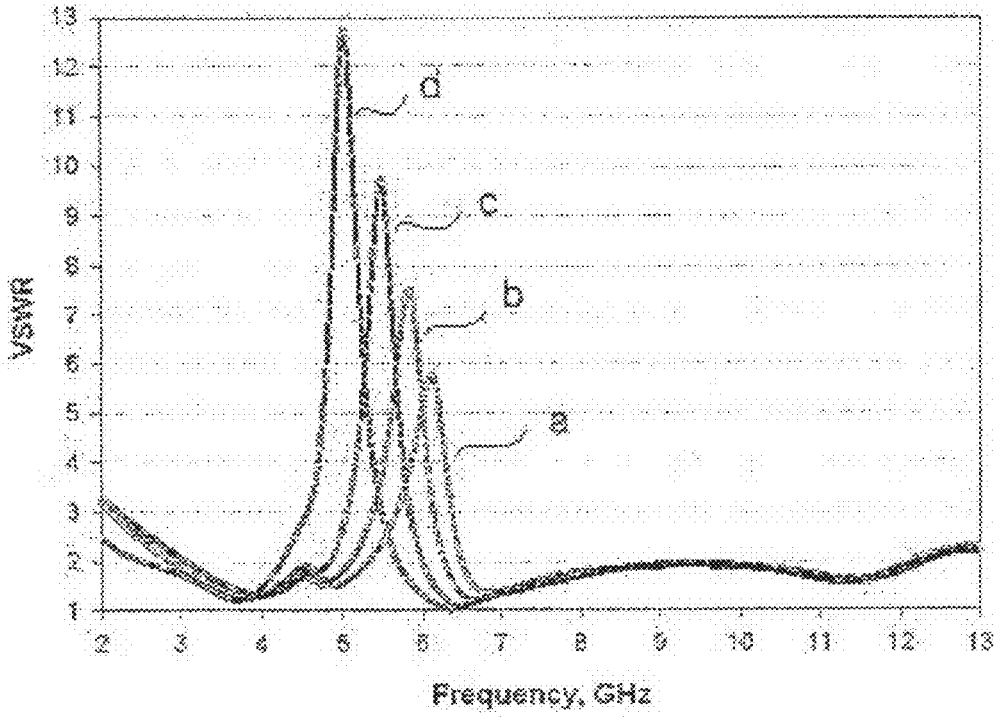

[Fig. 7]
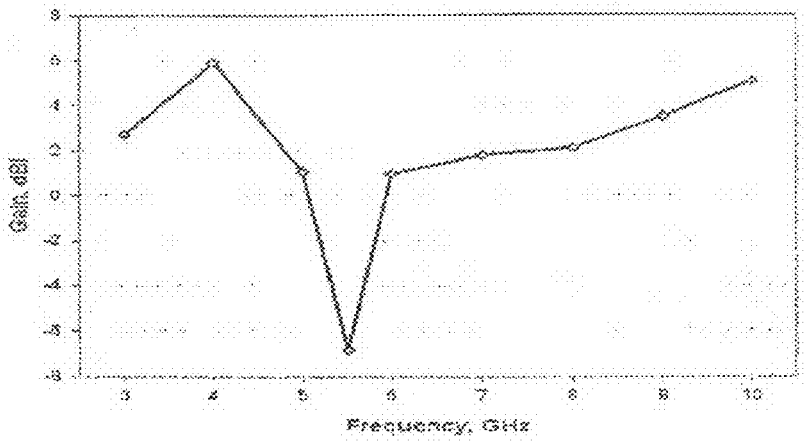
[Fig. 8]
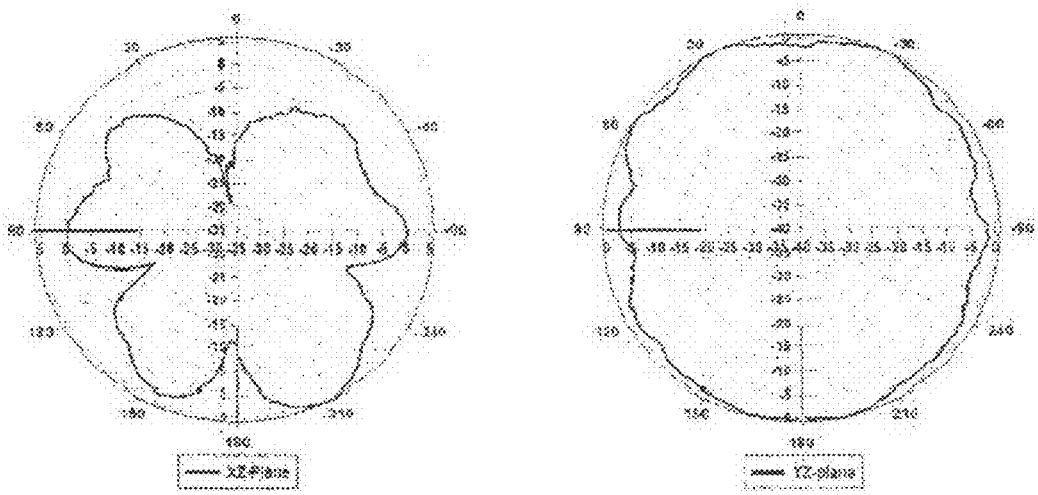
(a)
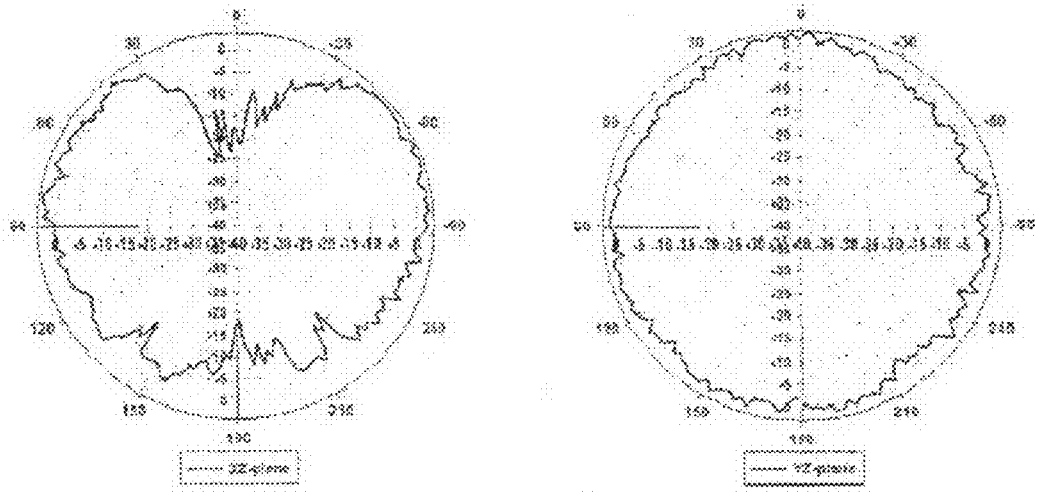
(b)

[Fig. 9]
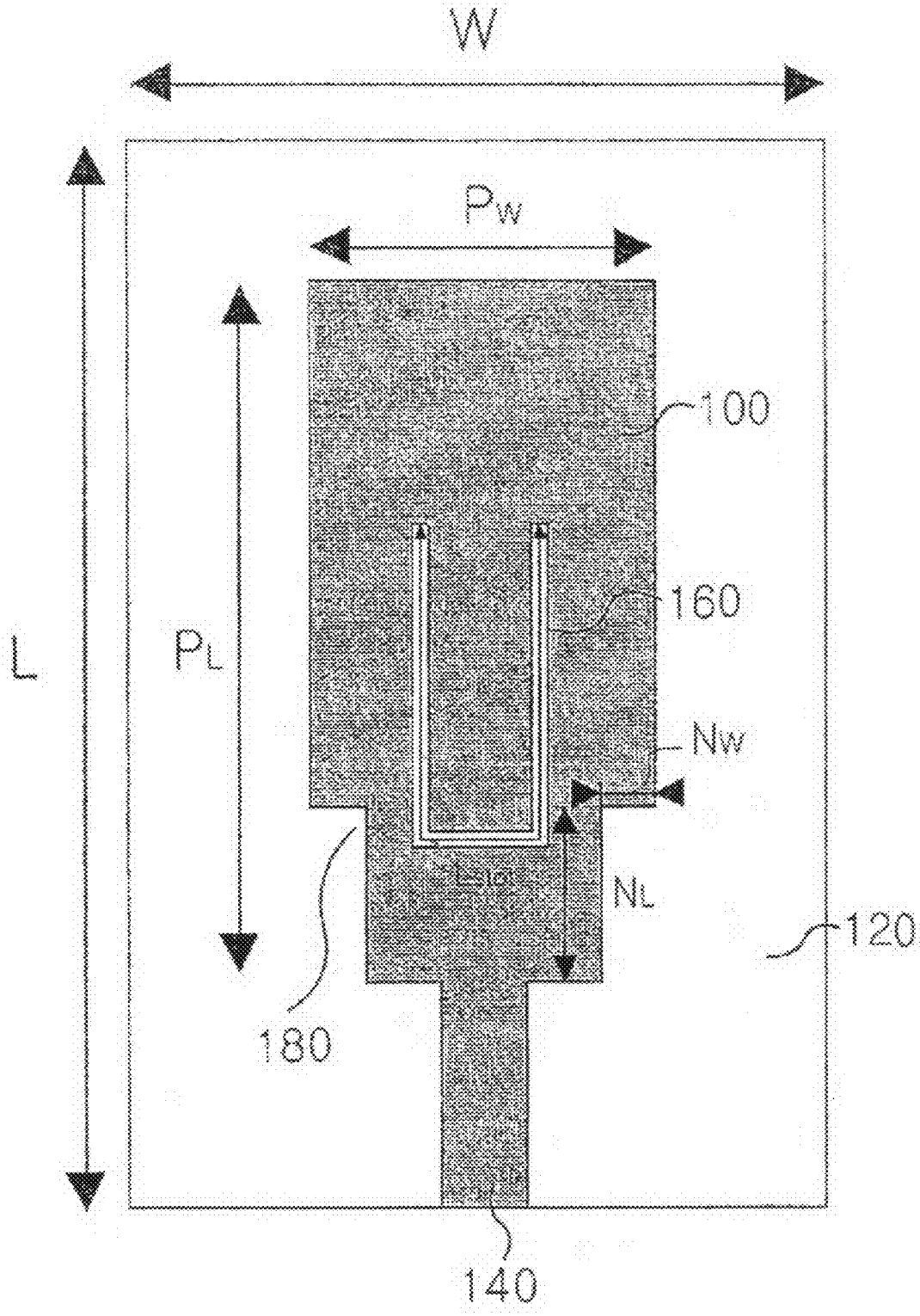

[Fig. 10]
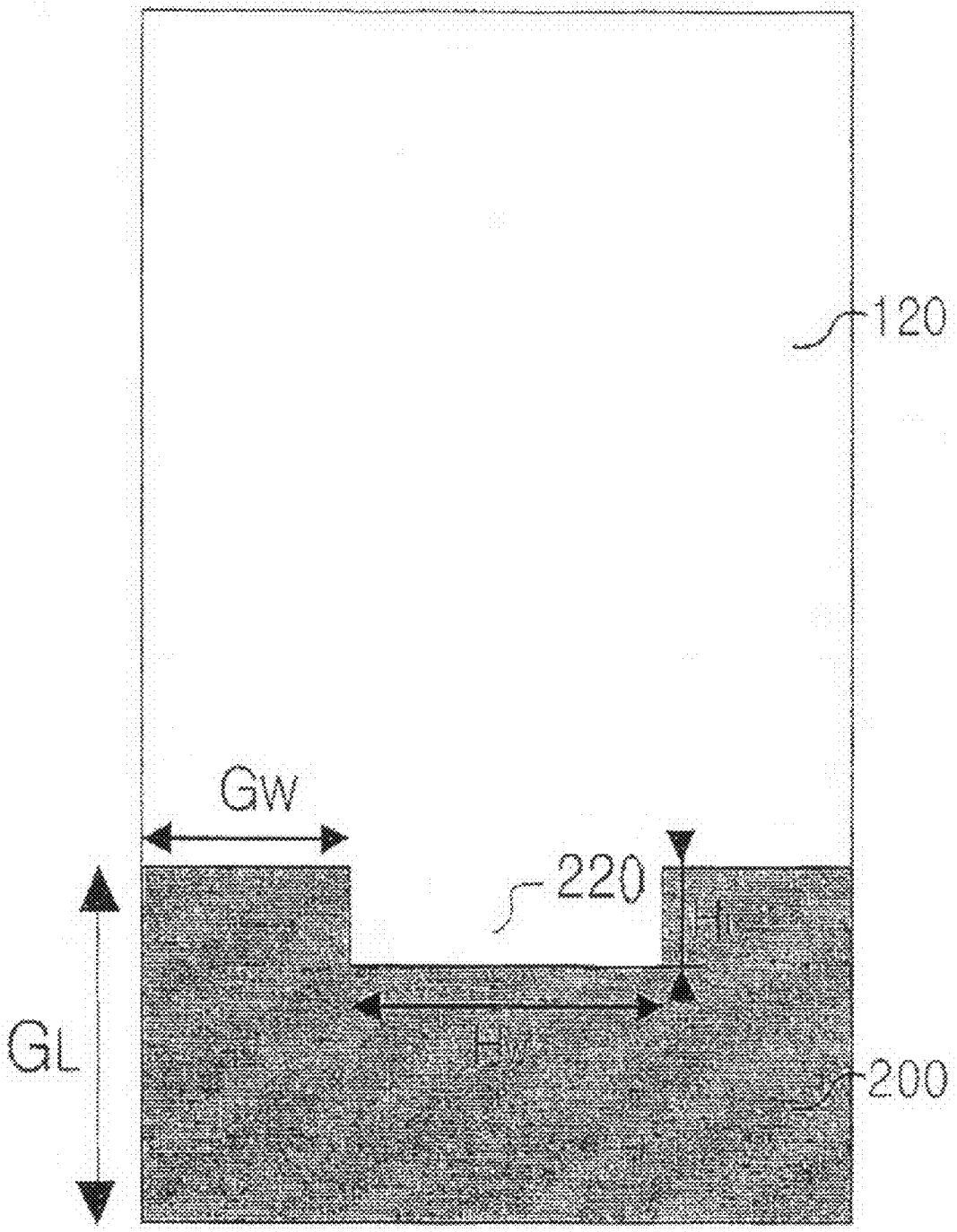

[Fig. 11]
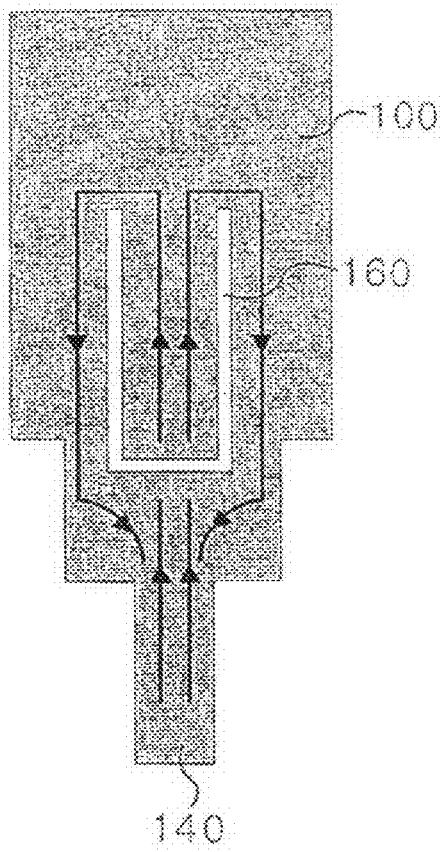
[Fig. 12]
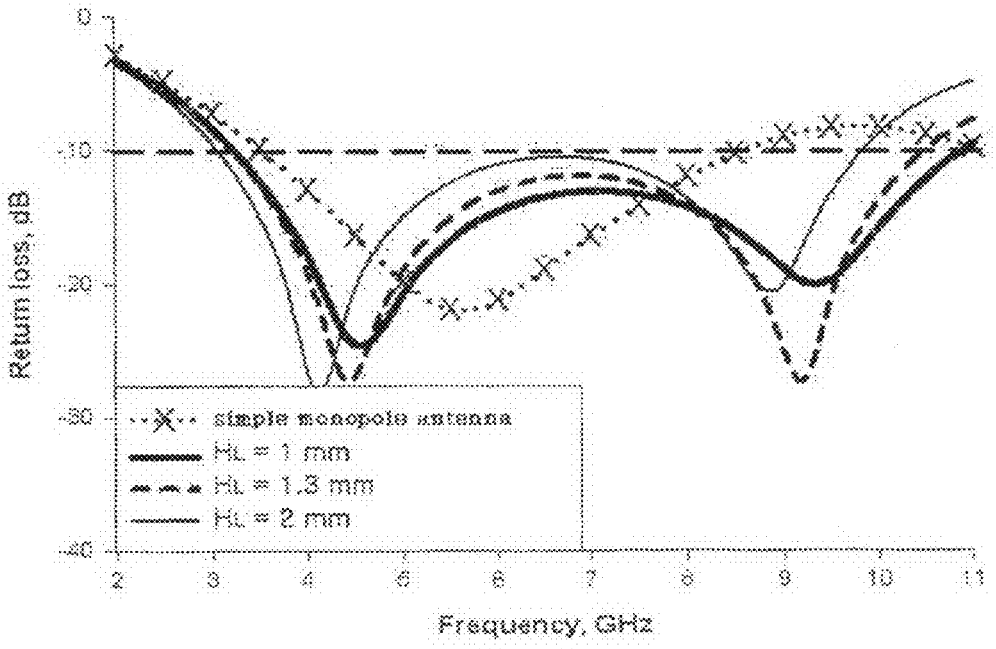

[Fig. 13]
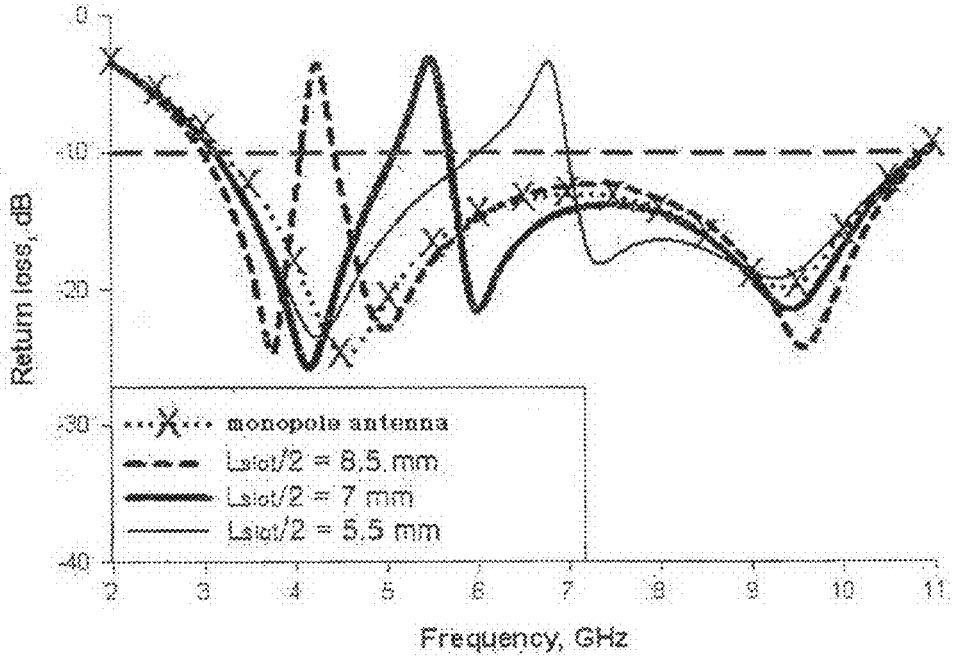
[Fig. 14]
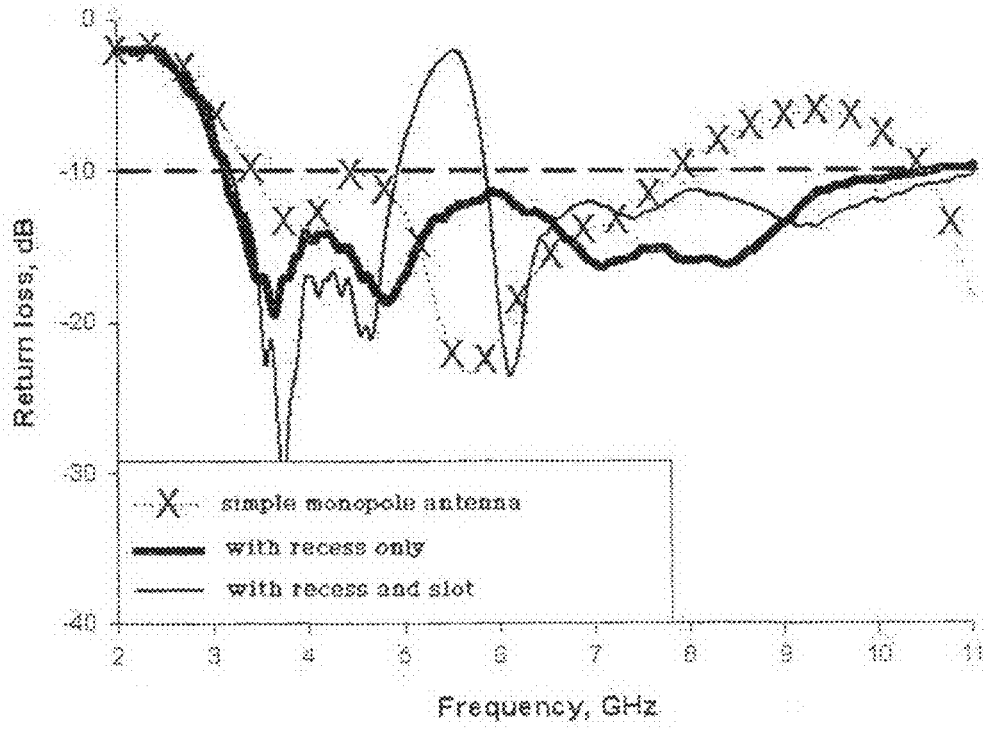

[Fig. 15]
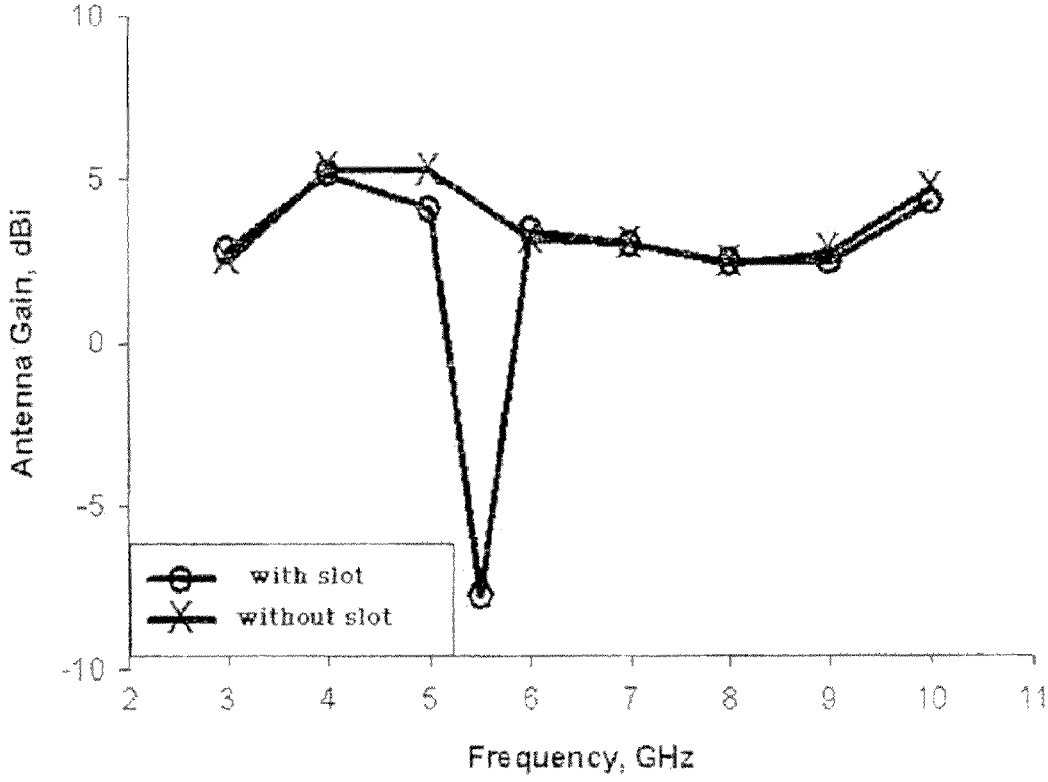

[Fig. 16]
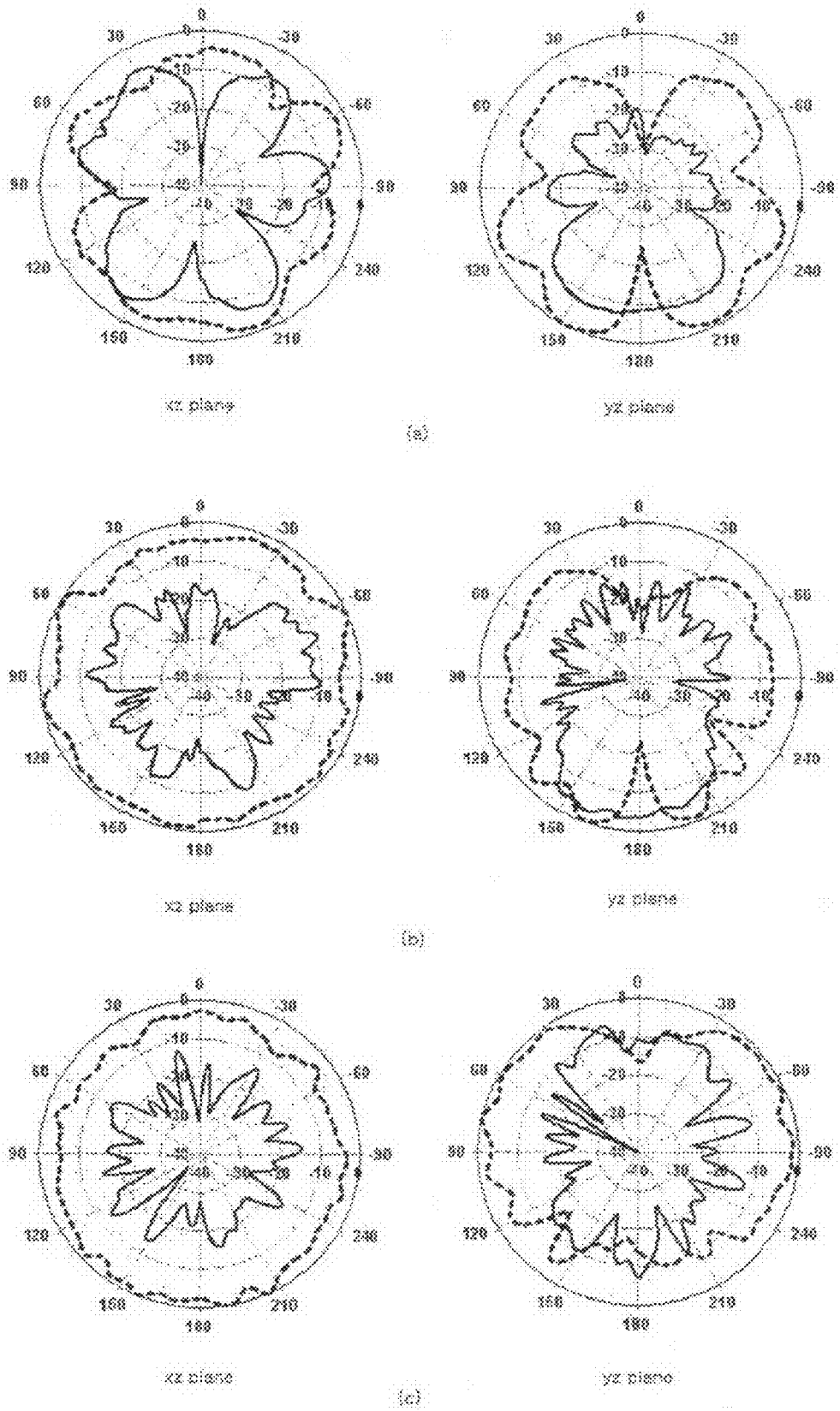

ULTRA-WIDEBAND ANTENNA HAVING A BAND NOTCH CHARACTERISTIC

CROSS-REFERENCE TO OTHER APPLICATIONS

This is a National Phase of International Application No. PCT/KR2006/001545, filed on Apr. 25, 2006, which claims priority from Korean Patent Application No. 10-2005-0034429 filed on Apr. 26, 2005 and Korean Patent Application No. 10-2005-0034430 filed on Apr. 26, 2005.

TECHNICAL FIELD

The present invention relates to an antenna for an Ultra-Wideband (UWB) communication system, and more particularly, to an UWB antenna having a band-stop characteristic at a frequency band of 5 GHz.

BACKGROUND ART

An UWB communication system is defined as a communication system having a bandwidth of 25% or more of a center frequency, or 1.5 GHz or more. UWB communication employs a signal whose power is diffused over a wide frequency band, such as an impulse signal. That is, a pulse having a several nanosecond to picosecond width (duration) is used in order to diffuse power over a wide frequency band of a GHz order. The UWB communication scheme is a communication scheme having a bandwidth much wider than that of a wideband CDMA communication scheme having a bandwidth of about 5 MHz.

In the UWB communication system, a signal is modulated so as to transfer information using a short pulse. A modulation method, such as OOK (On-Off Keying), PAM (Pulse Amplitude Modulation) or PPM (Pulse Position Modulation), is used in order to modulate a signal while maintaining a wideband characteristic of a pulse itself. Therefore, the UWB system is simple in structure and easy in implementation since it does not require a carrier. Furthermore, since power is diffused over a wide band, each frequency component requires very low power. This makes the UWB system less interfere with other communication systems that employ a narrow frequency band and also makes wiretapping difficult. Accordingly, the UWB system is suitable to maintain communication security. Furthermore, the UWB system is advantageous in that it allows for high-speed communication with very low power and has a good obstacle transmittance characteristic.

Due to the advantages, it is expected that the UWB system will be widely used in the field of the next-generation Wireless Personal Area Network (WPAN), such as a wireless home network. More particularly, U.S. Federal Communications Commission (FCC) approved that the UWB communication method could be used commercially at a frequency band of 3.1 GHz or more on February 2002. This accelerates the commercialization of the UWB system.

The UWB system employs a wide frequency band in comparison with a conventional communication system. It is therefore inevitable to develop a small antenna having a wideband characteristic suitable for the wide frequency band. An antenna for the UWB system generally includes a horn antenna, a bi-conical antenna, and so on. U.S. Pat. No. 6,621,462 issued to Time Domain Corporation, U.S. Pat. No. 6,590,545 issued to Xtreme Spectrum, Inc., etc. disclose other types of UWB antennas.

However, these antennas are problematic in that they are inappropriate for the fields requiring small and lightweight antennas because of its size.

Korean Patent Application No. 2003-49755 assigned to LG Electronics, Co., Ltd. and Korean Patent Application No. 2002-77323 assigned to Electronics and Telecommunications Research Institute (ETRI) disclose other types of UWB system antennas. These patent applications disclose a planar antenna or an inverse L-shaped antenna having a relatively small and wideband characteristic.

IEEE 802.11a and HYPERLAN/2 regulating the standards regarding wireless LAN regulates that a frequency band of 5.15 to 5.825 GHz (Unlicensed National Information Infrastructure (UNII) frequency band), which is included in a frequency band available to the UWB, be used in the wireless LAN. These standards may cause interference with the UWB system in the UNII band since a high-power signal is used. Accordingly, in the UWB system, the use of the UNII frequency band overlapped with that of the wireless LAN is limited.

However, the antennas disclosed in the above U.S. Patents and Korean Patent Applications have only the UWB characteristic, but do not have a band-stop characteristic at a frequency band whose use is limited. Therefore, in order for these antennas to be actually applied, it is required that a band-stop filter having a high quality factor against a frequency band overlapped with that of the wireless LAN be additionally used. However, to add the band-stop filter not only increases the cost, but also limit the miniaturization and light weight of an equipment. The addition of the band-stop filter also causes the distortion of a pulse in the UWB system using a very short pulse, resulting in a degraded performance.

DISCLOSURE OF INVENTION

Technical Problem

Accordingly, it is an object of the present invention to provide a UWB antenna that can be used in the UWB system.

It is another object of the present invention to provide a UWB antenna having a band-stop characteristic at a UNII band.

It is further another object of the present invention to provide a UWB antenna that can be miniaturized and can be mass-produced.

Technical Solution

To achieve the above objects, according to an embodiment of the present invention, there is provided a UWB antenna, including a substrate, a radiating element formed on a top surface of the substrate, a ground plane formed on a bottom surface of the substrate, and a feeding element connected to the radiating element, wherein a stub is formed in the radiating element and steps are formed in the ground plane.

The radiating element may be circular.

Furthermore, the stub may have a length ranging from 30° to 60°

According to another embodiment of the present invention, there is provided a UWB antenna, including a substrate, a radiating element formed on a top surface of the substrate, a ground plane formed on a bottom surface of the substrate, and a feeding element connected to the radiating element, wherein a recess is formed in the ground plane.

The radiating element may be rectangular, and a notch may be formed at a bottom edge of the radiating element.

Furthermore, the ground plane may be formed not to overlap with the radiating element.

Furthermore, the feeding element may be a microstrip feeding line.

Furthermore, a slot may be formed in the radiating element in order to obtain a band-stop characteristic.

The slot may have an inverse U shape and may have a length of 13 to 16 mm.

Furthermore, the slot may have a length of $$(\lambda_c/\sqrt{\epsilon_r})/2,$$

where $\epsilon_r$ is a relative dielectric constant of the substrate and $\lambda_c$ is a wavelength corresponding to a center frequency $f_c$ of a stop band.

In this case, the center frequency $f_c$ of the stop band may be in the range of 5 to 6 GHz.

According to further another embodiment of the present invention, there is provided a UWB antenna, including a substrate, a radiating element formed on a top surface of the substrate, a ground plane formed on a bottom surface of the substrate, and a feeding element connected to the radiating element, wherein a U-shaped slot is formed in the radiating element in order to obtain the band-stop characteristic.

Advantageous Effects

According to the present invention, a stub is formed in a radiating element. So that the UWB antenna having an expanded bandwidth at a low frequency band can be implemented.

Furthermore, according to the present invention, since steps are formed in a ground plane, an antenna characteristic at an intermediate frequency band can be improved and the bandwidth of an antenna can be expanded.

In addition, according to the present invention, since a slot is formed in the radiating element, a UWB antenna having a band-stop characteristic can be implemented.

Furthermore, according to the present invention, since a recess is formed in the ground plane, a UWB antenna having a wide bandwidth of 3 to 11 GHz can be implemented.

Furthermore, according to the present invention, a UWB antenna, which has light weight and a small size, is suitable for mass-production, and has an omnidirectional radiating pattern, can be implemented.

BRIEF DESCRIPTION OF THE DRAWINGS

FIG. 1 is a top view of an antenna according to an embodiment of the present invention;

FIG. 2 is a bottom view of the antenna according to an embodiment of the present invention;

FIG. 3 is a view diagrammatically showing the flow of current in a radiating element of the antenna according to an embodiment of the present invention;

FIG. 4 is a graph illustrating simulation values of a frequency versus a reflection coefficient depending on variation in a length ($\alpha$) of a stub according to an embodiment of the present invention;

FIG. 5 is a graph illustrating simulation values of a frequency versus a reflection coefficient depending on the formation of a step on a ground plane according to an embodiment of the present invention;

FIG. 6 is a graph illustrating a frequency versus a standing-wave ratio (VSWR) depending on the length ($L_{slot}$) of the slot according to an embodiment of the present invention;

FIG. 7 is a graph illustrating measurement values of a frequency versus a gain of an exemplary antenna implemented according to an embodiment of the present invention;

FIG. 8 is a graph illustrating radiating patterns depending on the frequency of the exemplary antenna implemented according to an embodiment of the present invention;

FIG. 9 is a top view of an antenna according to another embodiment of the present invention;

FIG. 10 is a bottom view of the antenna according to another embodiment of the present invention;

FIG. 11 is a view diagrammatically showing the flow of current in a radiating element of the antenna according to another embodiment of the present invention;

FIG. 12 is a graph illustrating simulation values of a frequency versus return loss depending on variation in a recess of a ground plane of the antenna according to another embodiment of the present invention;

FIG. 13 is a graph illustrating simulation values of a frequency versus return loss depending on variation in a length of a slot of the antenna according to another embodiment of the present invention;

FIG. 14 is a graph illustrating measurement values of a frequency versus return loss depending on the formation of the recess and the slot of the antenna according to another embodiment of the present invention;

FIG. 15 is a graph illustrating measurement values of a frequency versus a gain depending on the formation of the slot of the antenna according to another embodiment of the present invention; and FIG. 16 is a graph illustrating radiating patterns depending on the frequency of an exemplary antenna implemented according to another embodiment of the present invention.

DESCRIPTION ON REFERENCE NUMERALS

10,100: radiating element
12,120: substrate
14,140: feeding element
16,160: slot
18: stub
20,200: ground plane
22: step
180: notch
220: recess

BEST MODE FOR CARRYING OUT THE INVENTION

The present invention will now be described in detail in connection with specific embodiments with reference to the accompanying drawings. Though detailed shapes and related numeric values of an antenna are disclosed, it is to be understood that they are only illustrative. The described embodiments may be modified in various ways, all without departing from the spirit or scope of the present invention.

FIGS. 1 and 2 are top and bottom views of a UWB antenna according to an embodiment of the present invention.

The antenna of the present embodiment is basically a microstrip patch antenna, and it includes a substrate 12, a circular radiating element 10 formed on a top surface of the substrate, a feeding element 14 connected to the radiating element 10, and a ground plane 20 formed on a bottom surface of the substrate. An inverse U-shaped slot 16 may be formed in the radiating element 10. Steps 22 may be formed at both sides of an upper side of the ground plane 20. Furthermore, a stub 18 may be formed at the radiating element 10.

In the antenna of the present embodiment, the circular radiating element 10 is primarily used to obtain a wideband characteristic. Furthermore, in order to expand a bandwidth at a low frequency band, the stub 18 may be formed at the radiating element 10. Since an electrical length of the radiating element 10 can be increased due to the formation of the stub 18, an antenna characteristic at a low frequency (i.e., a long wavelength) band can be improved. By controlling the length of the stub 18, the degree of an expanded bandwidth can be controlled. In the present embodiment, it has been described that the stub 18 is formed on the same concentric circle as the radiating element 10. This is only illustrative. If the length of the stub 18 is maintained, the stub 18 may have various shapes.

Meanwhile, an antenna characteristic at an intermediate frequency band (about 6 GHz to 10 GHz) can be improved by forming the steps 22 on the ground plane 20. The ground plane 20 has an effect on the impedance matching of the antenna through coupling between the feeding element 14 and the radiating element 10. Therefore, the shape of the ground plane 20 can be changed in order to change the impedance (accordingly, bandwidth) of the antenna. In the present embodiment, the antenna characteristic at the intermediate frequency band was improved by forming the steps 22 on the ground plane 20. However, those skilled in the art will easily understand that the antenna characteristic can be improved even if the ground plane 20 is changed differently from the shapes mentioned above. These modifications also fall within the scope of the present invention.

Meanwhile, in the present embodiment, the ground plane 20 is formed only at a part of the bottom surface of the substrate 12 in such a way not to overlap with the radiating element 10. Accordingly, electromagnetic waves can be radiated from the radiating element 10 without being shielded by the ground plane 20 and an omnidirectional radiating pattern similar to that of a general monopole antenna can be obtained.

In the antenna of the present embodiment, the band-stop characteristic can be obtained by the inverse U-shaped slot 16 formed in the radiating element 10. The band-stop characteristic by the slot 16 will be described with reference to FIG. 3.

FIG. 3 is a graph diagrammatically showing the flow of current in the radiating element of the antenna according to an embodiment of the present invention. The progress of a current supplied to the radiating element 10 is hindered by the slot 16. The current makes a detour around the slot 16. In this case, as shown in FIG. 3, a current flowing inside the slot 16 and a current flowing outside the slot 16 have opposite directions. Accordingly, an electromagnetic field generated by the two currents can be canceled. In other words, since the slot 16 constitutes a half-wave resonant structure, radiation from a corresponding wavelength can be prohibited.

In this case, by controlling the length of the slot 16, a wavelength at which an electromagnetic field is canceled can be decided. In general, the electromagnetic wave of a free space is transferred as a wavelength of $$\lambda/\sqrt{\epsilon_r},$$

($\epsilon_r$ is a relative dielectric constant of a dielectric) within the dielectric. Accordingly, a length ($L_{slot}$) of the slot, which enables the slot to have the band-stop characteristic at a center frequency fc (a wavelength $\lambda_c$), can be expressed in the following equation.

$$L_{slot}=(\lambda_c/\sqrt{\epsilon_r})/2 \qquad \text{MathFigure 1}$$

As described above, in the present embodiment, since the slot 16 is formed in the radiating element 10, the band-stop characteristic can be added to the antenna. Since the center frequency of the stop band can be controlled by properly deciding the slot length, the band-stop characteristic at the UNII band can be induced. Furthermore, the bandwidth of the stop band can be controlled by controlling the width of the slot 16. In general, the wider the width of the slot 16, the wider the bandwidth of the stop band.

The present embodiment has been described above in connection with the inverse U-shaped slot. However, the present invention is not limited to the disclosed embodiment. Those having ordinary skill in the art will appreciate that the present invention can be applied to various shapes of slots within the spirit and scope of the invention disclosed in the specification.

Meanwhile, the antenna of the present embodiment uses a patch antenna that adopts microstrip feeding as the feeding element 14, as a basic structure. Therefore, the antenna of the present embodiment has accomplished the light-weight and miniaturization of the antenna and therefore has a structure suitable for mass production. Furthermore, the substrate 12 may be formed of FR4, high resistance silicon, glass, alumina, Teflon, epoxy or LTCC. More particularly, the FR4 substrate may be used in order to save the production cost.

The antenna according to the present embodiment was actually implemented and tested. The implemented antenna has the same construction as that shown FIGS. 1 and 2, and the dimensions of each constituent element are listed in the following table. The unit of each dimension is mm. Meanwhile, a microstrip feeder having a width of 2.6 mm and 54Ω was used as the feeding element 14, and a FR4 substrate having a thickness of 1.6 mm and a relative dielectric constant of 4.4 was used as the substrate 12. In the following table, "α" denotes the length of the stub.

TABLE 1

| L | W | R | α (°) | $G_L$ |
|---|---|---|---|---|
| 30 | 26 | 7 | 30~60 | 11.5 |
| $W_1$ | $W_2$ | $L_S$ | $W_S$ | $L_{slot}$ |
| 0.5 | 1 | 3 | 1 | 13~16 |

FIG. 4 is a graph illustrating simulation values of the frequency versus the reflection coefficient depending on variation in the length (α) of the stub according to an embodiment of the present invention. The circular radiating element 10 of the present embodiment was initially designed to resonate at 4.8 GHz at first. In contrast, when the stub 18 was formed, the resonant frequency was changed. It was found that the larger the length (α) of the stub, the greater the resonant frequency. It was also found that as the length of the stub is increased, a reflection coefficient characteristic at a low frequency was improved. In detail, there was a tendency that a simple circular radiating element had the reflection coefficient of −10 dB or less at 3.7 GHz or more, but a frequency having the reflection coefficient of −10 dB dropped to 3.7 GHz or less when the stub 18 was formed. Therefore, it was found that the bandwidth at a low frequency band could be expanded by forming the stub 18.

FIG. 5 is a graph illustrating simulation values of the frequency versus the reflection coefficient depending on the formation of the steps on the ground plane according to an embodiment of the present invention. In both curves of FIG. 5, the radiating element in which the stub having a length of 45 was formed was used, and only the shape of the ground plane 20 was different. The steps 22 have a width of 1 mm and have a height of 1 mm, 1.5 mm, 2 mm, and 2.5 mm, respectively in downward order on the substrate.

In the case where the ground plane 20 in which the steps 22 were not formed (dotted line), it was found that the reflection coefficient had −10 dB or more at an intermediate frequency band of about 6.26 to 10.3 GHz. In contrast, in the case where the steps 22 were formed (solid line), it was found that the reflection coefficient at the intermediate frequency band fell to −10 dB or less, resulting in an improved characteristic. In other words, the bandwidth was expanded at the intermediate frequency band due to the formation of the steps 22. As a result, an antenna having a good reflection coefficient of −10 dB or less over the entire available bands of 3.1 to 10.6 GHz, of the UWB system, was obtained.

FIG. 6 is a graph illustrating the frequency versus the standing-wave ratio (VSWR) depending on the length ($L_{slot}$) of the slot according to an embodiment of the present invention. In curves a to d, the lengths ($L_{slot}$) of the slots are 13 mm, 14 mm, 15 mm, and 16 mm, respectively. In overall, it can be seen that the standing-wave ratio is 2 or less in the range of 3 to 11 GHz and a UWB characteristic is shown accordingly. In the case where the slot 16 is formed as described above, the band-stop characteristic appears in the range of 4 to 7 GHz. Furthermore, as can be seen from the above equation, it was found that as the length ($L_{slot}$) of the slot increases, the center frequency of the stop band decreases. More particularly, when $L_{slot}$=15 mm (the curve c), the band-stop characteristic is obtained in the range of 4.9 to 6 GHz. Therefore, an antenna suitable to filter the UNII band can be obtained.

FIG. 7 is a graph illustrating measurement values of the frequency versus the gain of an exemplary antenna implemented according to an embodiment of the present invention. From FIG. 7, it can be seen that a good gain is obtained over the entire bands 3 to 10 GHz and the gain abruptly drops near the band 5 GHz, resulting in the band-stop characteristic. Accordingly, the antenna of the present embodiment has a characteristic suitable for an UWB antenna having less interference with other communication systems at the UNII band.

FIG. 8 is a graph illustrating radiating patterns depending on the frequency of the exemplary antenna implemented according to an embodiment of the present invention. FIGS. 8(*a*) and 8(*b*) illustrate the radiating patterns for 4 GHz and 9 GHz, respectively. The antenna implemented as described above employs a ground plane that is not overlapped with the radiating element and has a small area. Therefore, it can be seen that the antenna implemented as described above has an omnidirectional property similar to a general monopole antenna.

FIGS. 9 and 10 are top and bottom views of an antenna according to another embodiment of the present invention.

The antenna of the present embodiment is basically a microstrip patch antenna, and it includes a substrate 120, a rectangular radiating element 100 formed on a top surface of the substrate, a feeding element 140 connected to the radiating element 100, and a ground plane 200 formed on a bottom surface of the substrate. A U-shaped slot 160 may be formed in the radiating element 100 and a recess 220 may be formed in the ground plane 200. Furthermore, at a bottom edge of the radiating element 100 may be formed a notch 180.

The notch 180 formed at the bottom edge of the radiating element 100 introduces coupling between the ground plane 200 and the radiating element 100. Accordingly, the impedance matching of the antenna can be controlled by the notch 180 and an antenna bandwidth can be expanded accordingly. The bandwidth can be adjusted by controlling a length ($N_L$) and a width ($N_W$) of the notch.

Furthermore, in the present embodiment, the recess 220 may be formed in the ground plane 200 in order to implement the UWB characteristic. The recess 220 formed in the ground plane 200 also serves as an impedance matching circuit by way of coupling between the radiating element 100 and the feeding element 140. Therefore, impedance matching can be controlled by forming the recess 220 in the ground plane, of a portion at which the feeding element 140 is formed. Capacitance and inductance can be controlled by controlling a depth ($H_L$) and a width ($H_W$) of the recess 220. Therefore, the movement of a resonant frequency (i.e., the degree of a bandwidth expanded) can be controlled. In the present embodiment, it has been described that the recess 220 is formed in the ground plane 200. However, the present invention is not limited thereto, but the ground plane 200 may be modified in various shapes.

Meanwhile, in the present embodiment, the ground plane 200 may be formed only at a part of a bottom surface of the substrate 120 in such a way not to overlap with the radiating element 100. Accordingly, electromagnetic waves can be radiated from the radiating element 100 without being shielded by the ground plane 200 and an omnidirectional radiating characteristic similar to that of a general monopole antenna can also be obtained.

In the antenna of the present embodiment, the band-stop characteristic is obtained by the U-shaped slot 160 formed in the radiating element 100. The band-stop characteristic by the slot 160 will be described below with reference to FIG. 11.

FIG. 11 is a view diagrammatically showing the flow of current in the radiating element of the antenna according to another embodiment of the present invention. A current supplied through the feeding element 140 flows into the slot 160 by way of coupling. The current beginning from the inside of the slot 160 makes a detour around the outside of the slot 160 by way of coupling and then flows out through the feeding element 140. If the current flows as described above, the current flowing inside the slot and the current flowing outside the slot have opposite directions as shown in FIG. 11. Therefore, an electromagnetic field generated by the two currents can be canceled. In other words, since the slot 160 constitutes a half-wave resonant structure, radiation from a corresponding wavelength can be prohibited.

In this case, by controlling the length of the slot 160, a wavelength at which an electromagnetic field is offset can be decided. In general, an electromagnetic wave of a free space wavelength $\lambda$ is transferred as a wavelength of $$\lambda/\sqrt{\epsilon_r},$$

($\epsilon_r$ is a relative dielectric constant of a dielectric) within the dielectric. Therefore, the length ($L_{slot}$) of the slot, which enables the slot to have a band-stop characteristic at a center frequency $f_c$ (a wavelength $\lambda_c$), can be expressed in the above-mentioned math FIG. 1.

As described above, in the present embodiment, since the slot 160 is formed in the radiating element 100, the band-stop characteristic can be added to the antenna. Furthermore, the center frequency of the stop band can be controlled by properly deciding the slot length. It is therefore possible to induce the band-stop characteristic at the UNII band. In addition, by controlling the width of the slot 160, the bandwidth of the stop band can be controlled. In general, there is a tendency that as the width of the slot 160 is widened, the bandwidth of the stop band is increased.

The present embodiment has been described above in connection with the inverse U-shaped slot. However, the present invention is not limited to the disclosed embodiment. Those skilled in the art will appreciate that the present invention can be applied to various shapes of slots within the spirit and scope of the invention disclosed in the specification.

Meanwhile, the antenna of the present embodiment uses a patch antenna that adopts microstrip feeding as the feeding element 140, as a basic structure. Therefore, the antenna of the present embodiment has accomplished the light-weight and miniaturization of the antenna and therefore has a structure appropriate for mass-production. Furthermore, the substrate 120 may be formed of FR4, high-resistance silicon, glass, alumina, Teflon, epoxy or LTCC. More particularly, if the FR4 substrate is used, the production cost can be saved.

The antenna according to the present embodiment was actually implemented and tested. The implemented antenna has the same construction as that shown FIGS. 9 and 10, and the dimensions of each constituent element are listed in the following table. The unit of each dimension is mm. Meanwhile, the feeding element 140 had a width of 2 mm and a length of 5.5 mm, and a FR4 substrate having a thickness of 1.6 mm and a relative dielectric constant of 4.4 was used as the substrate 120.

TABLE 2

| W | L | $P_W$ | $P_L$ | $N_W$ |
|---|---|---|---|---|
| 16 | 18 | 7 | 11.5 | 1 |
| $N_L$ | $G_W$ | $G_L$ | $H_W$ | $H_L$ |
| 2.5 | 4.5 | 4 | 7 | 1~2 |

FIG. 12 is a graph illustrating simulation values of the frequency versus return loss depending on variation in the recess of the ground plane of the antenna according to another embodiment of the present invention. In FIG. 12, a graph of a simple monopole antenna shows that resonance occurs at the frequency of about 5.5 GHz and the return loss value is −10 dB or less at about 3 to 8 GHz bands. Meanwhile, a graph of an antenna in which the recess 220 is formed shows that resonance occurs near 4.5 GHz and near 9 GHz. The graph shows that it has improved impedance matching at a high frequency band of 8 GHz or more compared with the simple monopole antenna and the return loss value is kept to −10 dB or less, in general, at about 3 to 11 GHz bands. Accordingly, it was found that the UWB characteristic could be obtained by forming the recess 220.

FIG. 13 is a graph illustrating simulation values of the frequency versus return loss depending on variation in the length ($L_{slot}$) of the slot of the antenna according to another embodiment of the present invention. A curve when the slot is not formed will be described below. From FIG. 13, it can be seen that since the return loss value is kept to −10 dB or less from about 3 GHz to 11 GHz, the band-stop characteristic does not appear at the UNII band. In contrast, it can be seen that in a curve when the slot is formed, the return loss values are increased up to about −3 dB in 4 GHz, 5 GHz, and 6 GHz bands, respectively, enabling the band-stop characteristic to appear. More particularly, it can be seen that as the length ($L_{slot}$) of the slot is shortened, the center frequency of the stop band increases from 4.3 GHz to 6.5 GHz. When the length of the slot was 14 mm ($L_{slot}/2$=7 mm), the band-stop characteristic appeared at the UNII band.

FIG. 14 is a graph illustrating measurement values of the frequency versus return loss depending on the formation of the recess and the slot of the antenna according to another embodiment of the present invention. Compared with the simple monopole antenna, when only the recess is formed, the impedance matching effect is obtained at the high frequency band (about 7.9 GHz to 10.5 GHz) and the bandwidth is expanded, and when both the recess and the slot are formed, the band-stop characteristic additionally appears at a 5 GHz band (UNII band) (in detail, 4.92 GHz to 5.86 GHz), in the same manner as that shown in the simulation. Accordingly, by forming both the recess and the slot, a UWB antenna having the band-stop characteristic at 4.92 GHz to 5.86 GHz and a bandwidth of 3.1 GHz to 11.25 GHz can be implemented.

FIG. 15 is a graph illustrating measurement values of the frequency versus the gain depending on the formation of the slot of the antenna according to another embodiment of the present invention. From the graph, it can be seen that an antenna in which a slot is not formed does not show the band-stop characteristic, but an antenna having the slot formed therein shows the band-stop characteristic since the gain is significantly decreased at 5 GHz. Furthermore, the graph shows that the gain is varied within a range of 2.8 dBi or less over the whole frequency bands (3 GHz to 11 GHz).

FIG. 16 is a graph illustrating radiating patterns depending on the frequency of an exemplary antenna implemented according to another embodiment of the present invention. FIGS. 16(*a*), 16(*b*), and 16(*c*) illustrate radiating patterns for 3 GHz, 6 GHz, and 9 GHz, respectively. In the graphs, dotted lines indicate radiating patterns for co-pol and solid lines indicate radiating patterns for cross-pol. The antenna implemented as described above employs the ground plane that is not overlapped with the radiating element and has a small area. Therefore, it can be seen that the antenna has an omnidirectional characteristic similar to a general monopole antenna.

What is claimed:

1. A ultra-wideband (UWB) antenna, comprising:

a substrate;

a circular radiating element formed on a top surface of the substrate;

a ground plane formed on a bottom surface of the substrate, wherein at least one step is formed in the ground plane;

a feeding element connected to the radiating element; and a stub formed at the radiating element to expand a bandwidth at a low frequency band, wherein the stub has a length ranging from 30° to 60° of a circular path with a radius greater than a radius of the circular radiating element.

2. The UWB antenna according to claim 1, wherein the ground plane is formed not to overlap with the radiating element.

3. The UWB antenna according to claim 1, wherein the feeding element is a microstrip feeding line.

4. The UWB antenna according to claim 1, wherein a slot is formed in the radiating element to obtain a band-stop characteristic.

5. The UWB antenna according to claim 4, wherein the slot has an inversed U-shape.

6. The UWB antenna according to claim 4, wherein the slot has a length ranging from 13 to 16 mm.

7. The UWB antenna according to claim 4, wherein the slot has a length of $$(\lambda_c/\sqrt{\epsilon_r})/2,$$

where $\epsilon_r$ is a relative dielectric constant of the substrate and $\lambda_c$ is a wavelength corresponding to a center frequency $f_c$ of a stop band.

8. The UWB antenna according to claim 7, wherein the center frequency $f_c$ of the stop band is in a range of 5 to 6 GHz.

9. A UWB antenna, comprising:

a substrate;

a rectangular radiating element formed on a top surface of the substrate, wherein a notch is formed at a bottom edge of the rectangular radiating element and wherein bandwidth of the antenna can be adjusted by controlling a length and width of the notch;

a ground plane formed on a bottom surface of the substrate; and a feeding element connected to the radiating element, wherein a recess is formed in the ground plane.

10. A UWB antenna having a band-stop characteristic, comprising:

a substrate;

a radiating element formed on a top surface of the substrate;

a ground plane formed on a bottom surface of the substrate; and a feeding element connected to the radiating element, wherein a U-shaped slot is formed in the radiating element to obtain the band-stop characteristic, wherein the slot has a length of $$(\lambda_c/\sqrt{\in_r})/2,$$

where $\in_r$ is a relative dielectric constant of the substrate and $\lambda_c$ is a wavelength corresponding to a center frequency $f_c$ of a stop band.

* * * * *